US005193227A

United States Patent [19]

Crowley, Jr.

[11] Patent Number: 5,193,227

[45] Date of Patent: Mar. 16, 1993

[54] VENTILATING SYSTEM FOR CONTINUOUSLY REMOVING AIR FROM A TOLIET BOWL

[76] Inventor: Jim C. Crowley, Jr., #12 Sandpiper Rd., Hilton Head Island, S.C. 29928

[21] Appl. No.: 741,746

[22] Filed: Aug. 7, 1991

[51] Int. Cl.[5] ..... E03D 9/052

[52] U.S. Cl. ..... 4/213; 4/216

[58] Field of Search ..... 4/213, 216, 351; 137/533.11, 533.13

[56] References Cited

U.S. PATENT DOCUMENTS

| | | | |
|---|---|---|---|
| 263,815 | 9/1882 | Schomp | 137/533.11 |
| 622,720 | 4/1899 | Sieben | 137/533.13 X |
| 704,471 | 7/1902 | Brown | 4/213 |
| 783,493 | 2/1905 | Wood | 137/533.13 X |
| 1,424,955 | 8/1922 | Van Eck | 4/213 |
| 1,427,098 | 8/1922 | Fortier | 137/533.11 X |
| 1,931,052 | 10/1933 | Baither | 4/213 |
| 2,112,772 | 3/1938 | Greene | 4/213 |
| 2,297,935 | 10/1942 | Baither | 4/213 |
| 2,652,849 | 9/1953 | Ebbs et al. | 137/533.11 X |
| 2,724,840 | 11/1955 | Scott et al. | 4/213 X |
| 2,728,921 | 1/1956 | Dorko | 4/216 |
| 3,122,757 | 3/1964 | Sowards | 4/213 |
| 3,534,415 | 10/1970 | Huffman | 4/213 |
| 3,902,203 | 9/1975 | Poister | 4/213 |
| 3,913,150 | 10/1975 | Poister | 4/213 |
| 4,175,293 | 11/1979 | Stephens | 4/213 X |
| 4,893,359 | 1/1990 | Vu et al. | 4/216 |
| 5,054,131 | 10/1991 | Sim | 4/216 |

FOREIGN PATENT DOCUMENTS

| | | | |
|---|---|---|---|
| 0873828 | 4/1953 | Fed. Rep. of Germany | 4/213 |

*Primary Examiner*—Henry J. Recla
*Assistant Examiner*—Robert M. Fetsuga
*Attorney, Agent, or Firm*—Terry M. Gernstein

[57] ABSTRACT

A ventilating system includes a manifold connected to the interior of a toilet bowl, and a system for continuously moving air from that toilet bowl to a discharge system. A flow control valve prevents water from moving through the system and includes a cage containing a ball both of which are oriented nearly horizontally with the valve preventing water that is inadvertently located in the air flow path from moving through the discharge system, and a solar energy-driven expansion chamber is connected to the discharge conduit to establish a flow producing pressure gradient throughout the system.

3 Claims, 13 Drawing Sheets

VENTILATING SYSTEM FOR CONTINUOUSLY REMOVING AIR FROM A TOLIET BOWL

TECHNICAL FIELD OF THE INVENTION

The present invention relates to the general art of water closets, and to the particular field of ventilating systems for use with water closets.

BACKGROUND OF THE INVENTION

Odorous air associated with toilets has long been a problem of interest in the art. The art contains many examples of air evacuation systems intended to remove such air from the vicinity of the water closet. Many of these systems include a fan that is operated either manually or automatically when the water closet is in use.

While somewhat effective, especially when the fan is in operation, many of these systems have drawbacks. The principal drawback arises because the fan must be turned on for the air removing system to be effective. Thus, someone must remember to turn a fan on, or the effectiveness of the system will be seriously vitiated. This is not a great problem in a residence; however, in a commercial building, especially one having many floors and many water closets, this problem could be serious.

Another drawback associated with such intermittently operated evacuation systems arises because the inertia of the air in the system when the fan is initially activated must be overcome before the system begins to function to remove air from the vicinity of the water closet. That is, all of the air located between the fan and the water closet as well as all of the air in the system itself, is at rest when the fan is first activated. This at-rest air has an inertia that must be overcome. The more air there is, the more inertia that must be overcome. This situation causes the fan to spend the initial period of its operation overcoming the inertia of the at-rest air in the system. This situation delays the movement of odorous air from the vicinity of the toilet. During system start up, noxious air will remain in the vicinity of the water closet, which may be undesirable, especially in a community bathroom. Furthermore, if the fan is to be operated for a limited time, the overall effectiveness of the air evacuation system may be decreased, thereby degrading the efficiency of the system.

Therefore, there is a need for a ventilating system that effectively and efficiently evacuates air from the vicinity of a toilet on a continuous basis.

Still further, since such a system is most efficient when it operates on a continuous basis, the system should have as few moving or mechanical parts as possible. Therefore, there is a need for a ventilating system that is reliable when operating on a continuous basis.

Many present air evacuation systems have the fan thereof located in a position spaced from the toilet. This severely degrades the performance of the system for several reasons. One reason arises because of the extra air the fan must move due to its location. Another reason is the delay period arising because of the spacing between the fan and the toilet.

Therefore, some systems make direct fluidic connection between the fan and the toilet bowl. However, such direct connection generally precludes continuous operation of the system. Should the toilet bowl overflow, the operating fan may pull the water into the air evacuation system thereby creating problems.

Therefore, there is a need for a ventilating system that can be connected directly to a toilet bowl, yet will not have a significant possibility of a damage due to a toilet overflow situation.

Still further, there is a need for a toilet vent system that can be adapted to accommodate a plurality of toilets whereby a single ventilation system can be used for a large building having many bathrooms.

Still further, since many water closets are already in place, it is not economically feasible to remove such toilets and replace them with entirely new toilets that are part of a ventilation system. This problem will inhibit the commercial success of any such system.

Therefore, there is a need for a toilet ventilation system that can be easily retro-fit onto existing toilet installations.

Since chemicals and filters are not always desirable or efficient, the most effective system with the widest range of applications utilizes the aforementioned ventilation system.

OBJECTS OF THE INVENTION

It is a main object of the present invention to provide a ventilating system that effectively and efficiently evacuates air from the vicinity of a toilet on a continuous basis.

It is another object of the present invention to provide a ventilating system for use in connection with a water closet that makes direct fluidic connection with the interior of the toilet bowl, yet does so in a manner that does not present a significant possibility of damaging the evacuation system.

It is another object of the present invention to provide a ventilating system for use in connection with a water closet that can be adapted to accommodate a plurality of toilets.

It is another object of the present invention to provide a ventilating system for use in connection with a water closet that has a high degree of reliability.

It is a specific object of the present invention to provide a ventilating system for use in conjunction with a water closet that can be operated on a continuous basis yet has no moving parts.

It is another specific object of the present invention to provide a ventilating system for use in conjunction with a water closet that can be operated on a continuous basis using solar-driven energy sources.

It is another object of the present invention to provide a ventilating system for use in connection with a water closet that can be retro-fit into existing systems.

SUMMARY OF THE INVENTION

These, and other, objects are achieved by a ventilating system that continuously evacuates air from the immediate vicinity of a water closet bowl interior. The system has an inlet in direct fluidic connection with the interior of the toilet bowl and includes flow control elements that prevent water from the toilet from flowing into the system. Each toilet of the system can be modified in one of several ways to accommodate the ventilation system whereby existing appliances can be retro-fit with the ventilation system disclosed herein. The ventilation system further includes means for connecting a plurality of toilets together, and power means that can be continuously operated. The power means can include a solar energy-driven expansion chamber.

The direct connection and continuous operation of the ventilation system efficiently evacuates air from the immediate vicinity of the toilet, yet the system includes means for preventing water from the toilet from flowing into the ventilation system in a manner that may damage that system. The system is easily modified to accommodate a plurality of toilets, both existing and newly installed, and provides several modes of fluidically connecting the ventilation system to the interior of the toilet bowl whereby the most efficient connection can be effected. The use of solar power further increases the efficiency and reliability of the system. Yet this advantage is further enhanced in the system of the present invention by augmenting the solar energy-driven power source with other power sources to ensure continuous operation in all situations and under all conditions. The solar energy-driven forms of the ventilation system do not require any moving parts or mechanical elements so the reliability of the overall system is increased.

BRIEF DESCRIPTION OF THE DRAWING FIGURES

DETAILED DESCRIPTION OF THE PREFERRED EMBODIMENT OF THE INVENTION

Figure 1:
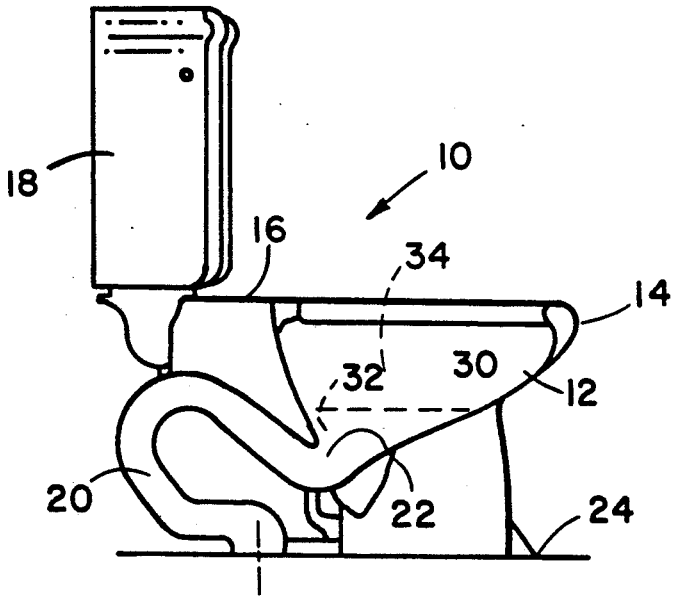
FIG. 1 PRIOR ART
FIG. 1 is a side elevational view of a typical water closet.

The ventilating system of the present invention is intended for use in conjunction with a water closet 10 such as shown in FIG. 1 to remove air from the immediate vicinity of a toilet bowl 12. The ventilating system of the present invention is embodied in two forms, one form being shown in FIGS. 2–5 and one form being shown in FIGS. 9–16. Either of these forms of the invention can be used on new or existing water closets. The system is intended to operate continuously, and thus includes two preferred forms of air moving means, one form including a fan and being shown in FIGS. 2–5 and 8, and another form including a solar energy-driven expansion chamber and being shown in FIGS. 24–27. The system is intended to be in direct fluidic communication with the interior of the toilet bowl, and thus includes a flow control means, best shown in FIGS. 5, 6 and 21 –23, and can be used in conjunction with a plurality of toilets, as indicated by the piping systems shown in FIGS. 18–20. The system will be disclosed in conjunction with and with reference to these figures.

As is best shown in FIGS. 1–5, the toilet bowl 12 includes a front end 14 and a rear end 16 on which a water tank 18 is located. The toilet includes a sewage disposal system having a sewage disposal pipe 20 connected to the bowl 12 via a trap 22 and rests on a floor 24. The toilet also includes a cover 26 hingeably connected to the rear end 16 and a toilet seat 28 also hingeably connected to the bowl rear end 16. Both the seat and the cover or lid rest on the toilet bowl upper rim 30 when the toilet is closed. Water 32 from the water tank is stored in the interior 34 of the bowl. The toilet 10 operates in the usual manner to move water and waste to the sewage disposal system.

Figure 2:
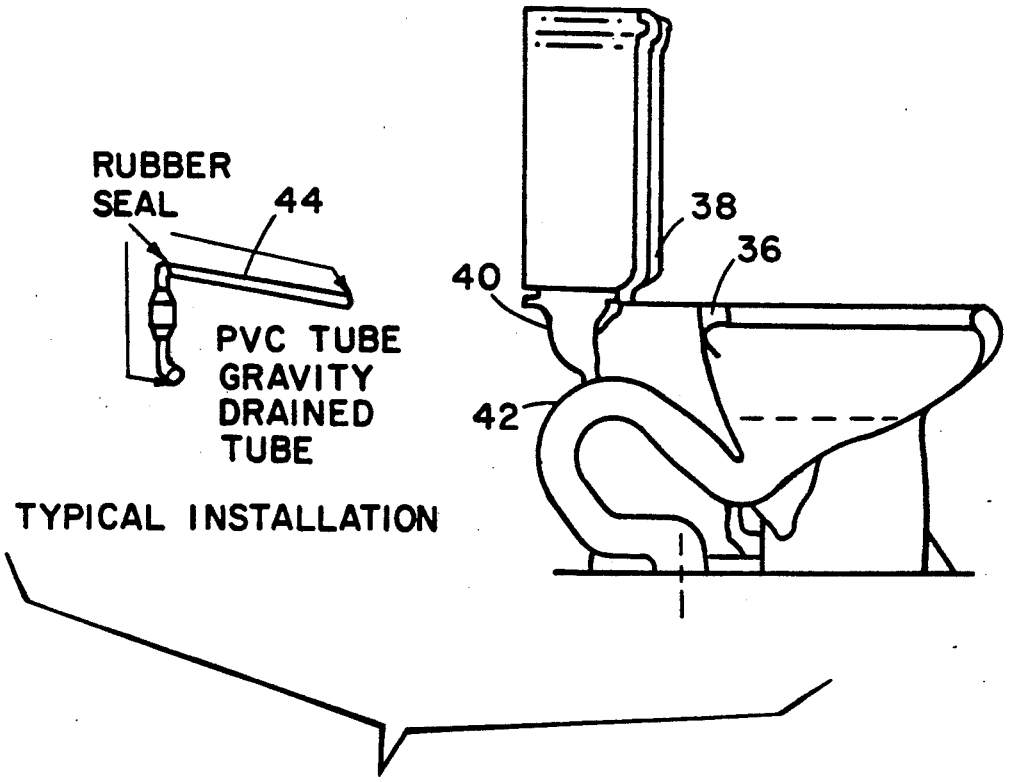
FIG. 2 is a side elevational view of a water closet that has been modified to accommodate one form of the ventilation system of present invention.
Figure 3:
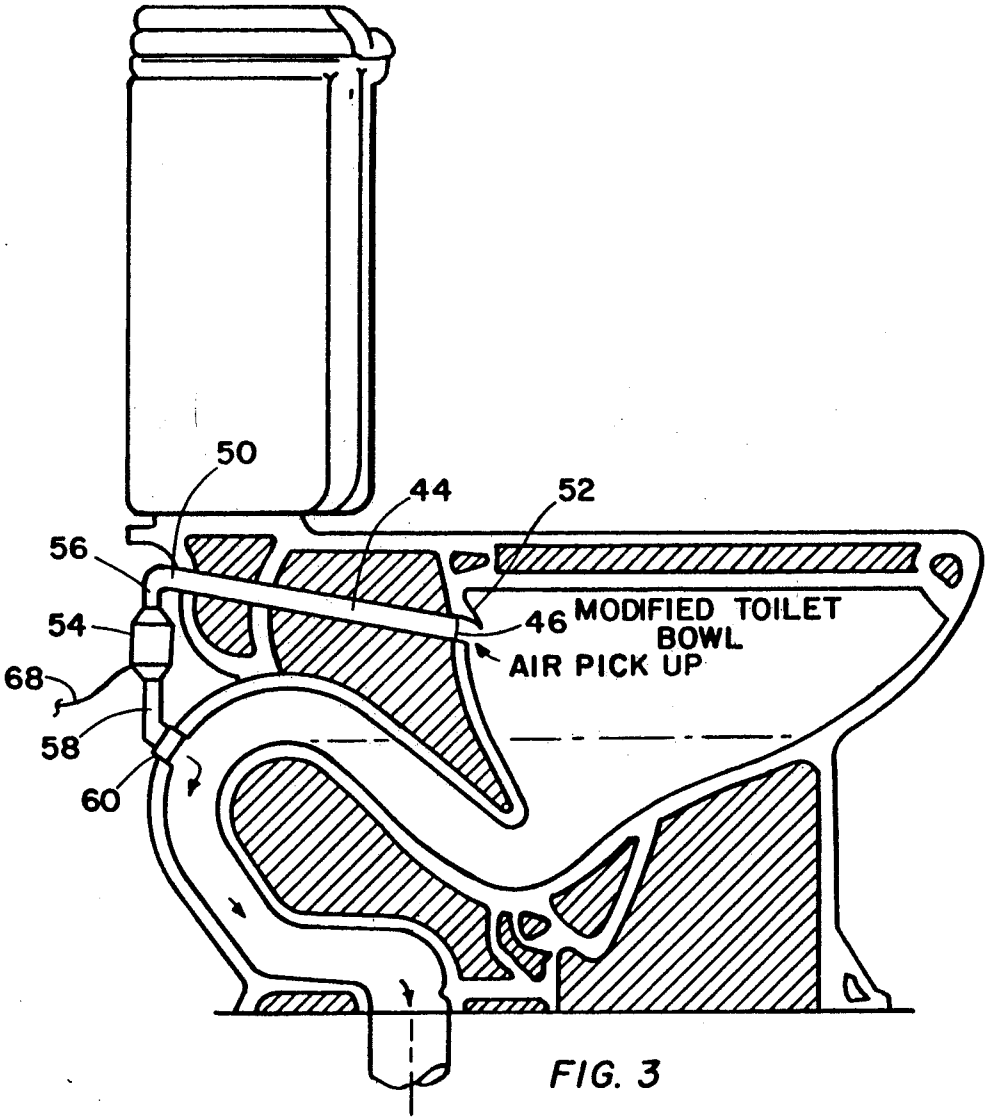
FIG. 3 is a side elevational view of the FIG. 2 set up in an assembled condition.
Figure 4:
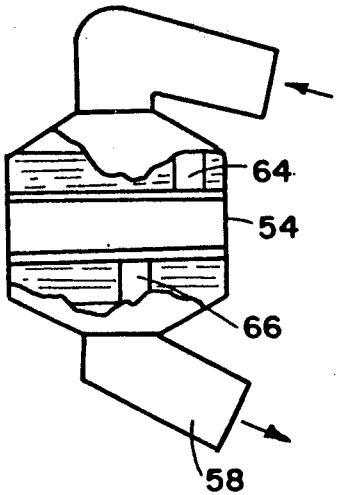
FIG. 4 is a cutaway side elevational view of an axial flow fan that can be incorporated into the ventilation system of the present invention.

A first form of the present invention is illustrated in FIGS. 2-5 and includes a plurality of holes, such as holes 36, 38 and 40 defined through the toilet bowl and the tank supporting portions of the toilet as indicated in FIG. 2. Another hole, hole 42, is defined into the sewage disposal pipe 20. An air pick-up conduit 44 is positioned through holes 36, 38 and 40 and includes an inlet end 46 located in the toilet bowl to be in direct fluidic communication with the interior of that bowl. Suitable gaskets can be placed in each hole to support the conduits placed in the holes and to act as stops to ensure proper placement of the conduits. The air pick-up conduit also includes an outlet 50 that is positioned vertically above the inlet 46 whereby the air pick-up conduit is angled upwardly from the inlet to the outlet. This upward angled orientation of the conduit 44 works to prevent water from moving into the air evacuation system via the conduit 44. A lip 52 is positioned on the toilet bowl above the inlet 46 so water used in a normal flush cycle will not move into the conduit 44.

Figure 8:
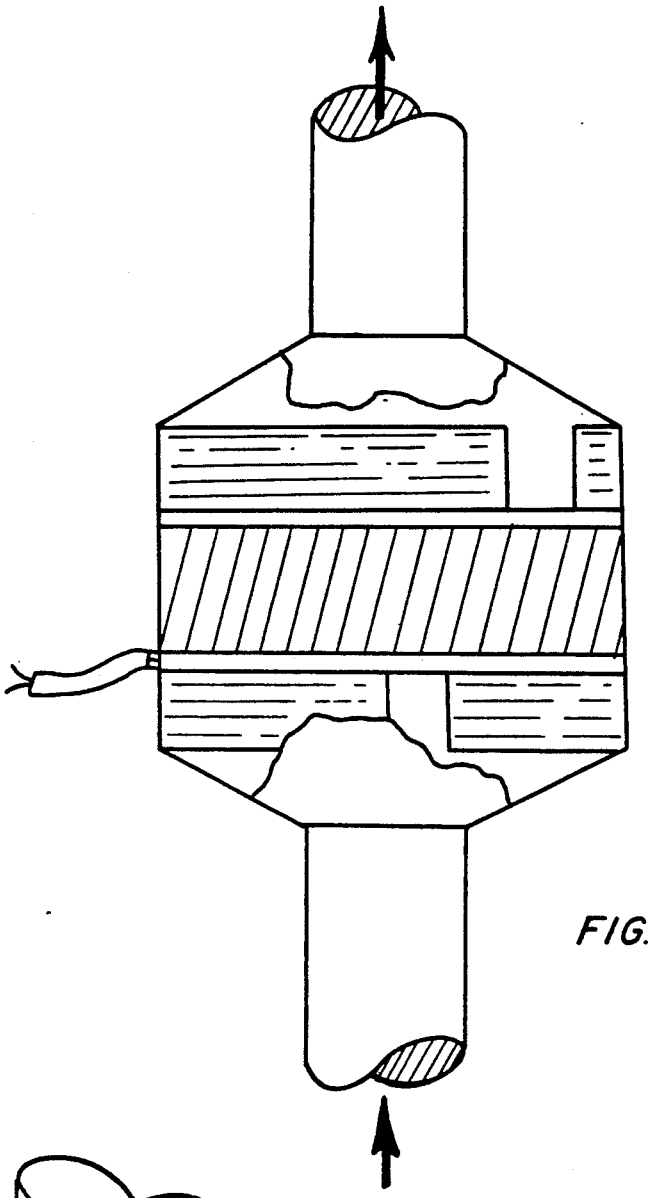
FIG. 8 is a cutaway side elevational view of another fan that can be used in conjunction with the system of the present invention.
Figure 7:
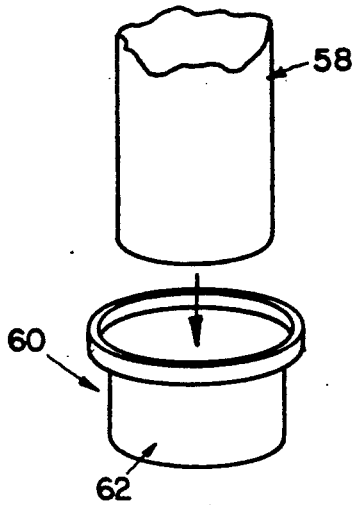
FIG. 7 is an exploded perspective view of a connection that can be used to connect an air discharge conduit to another portion of the existing water closet installation downstream of the fan.
Figure 10:
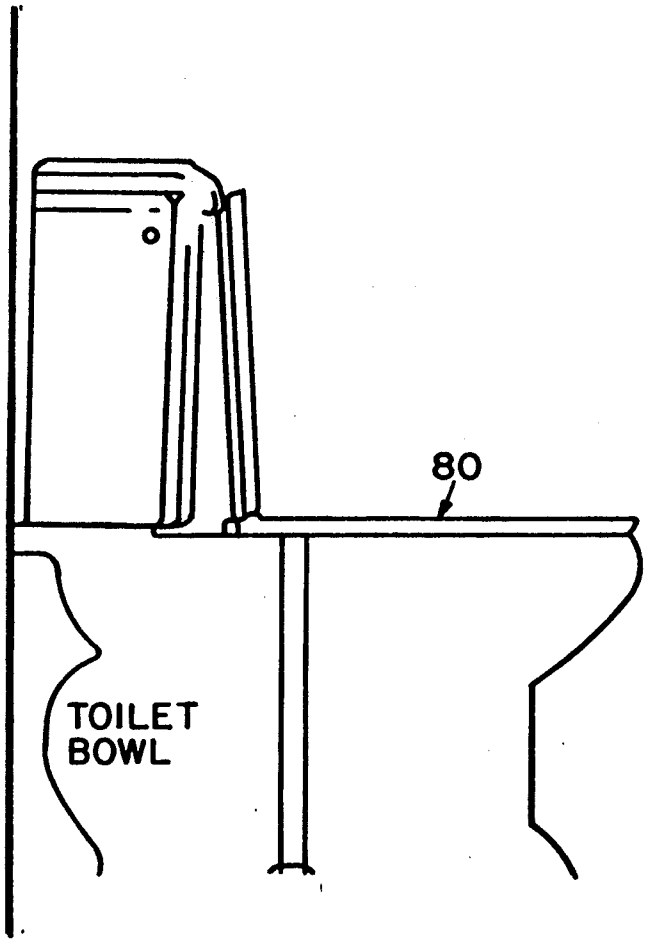
FIG. 10 illustrates the FIG. 9 form of the invention with the lid in the open condition.
Figure 9:
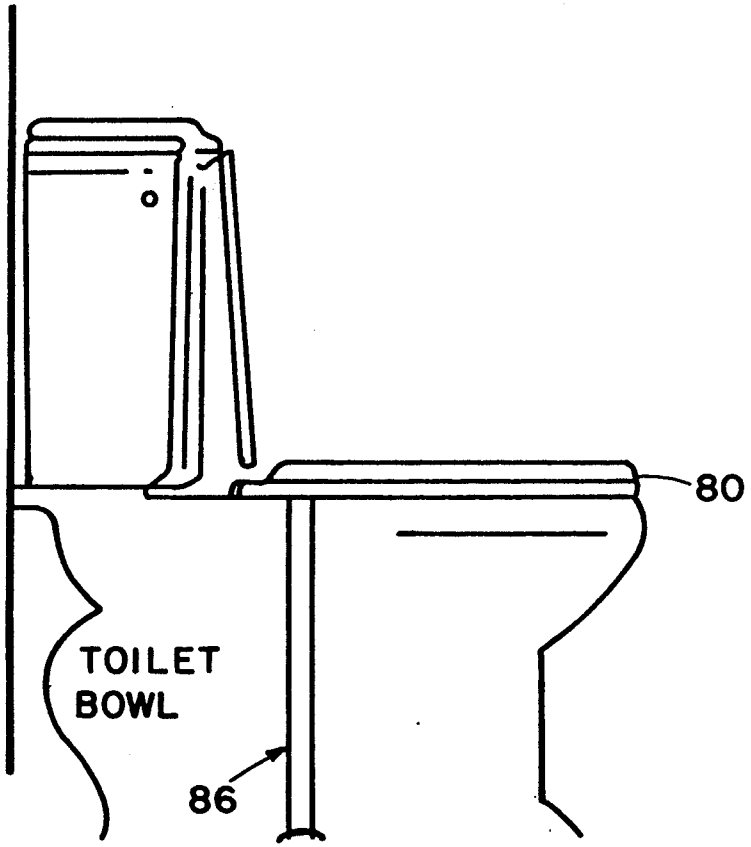
FIG. 9 is a side elevational view of another form of the ventilation system of the present invention with the lid of the toilet in the closed condition.

The system shown in FIGS. 2-5 is intended to operate continuously, and includes a means for moving air out of the toilet bowl. This means includes an axial fan 54 having an inlet section 56 fluidically connected to the air pick-up conduit outlet 50 to receive air therefrom, and an outlet section 58 fluidically connected to the discharge pipe 20. Another form of the fan is shown in FIG. 8. The connection between the section 58 and the conduit 20 occurs downstream of the sewer trap 22. It is here noted that directions will be taken with reference to the flow direction of water moving out of the toilet, so that connection 60 between the section 58 and the conduit 20 is downstream of the bowl 12. The connection 60 is shown in greater detail in FIG. 7 as including a collar 62 that is mounted on the conduit 20 adjacent to the hole 42. The axial flow fan includes an inlet port 64 and an outlet port 66. A suitable power source, such as utility power can be applied to the fan via a power cord 68.

Figure 5:
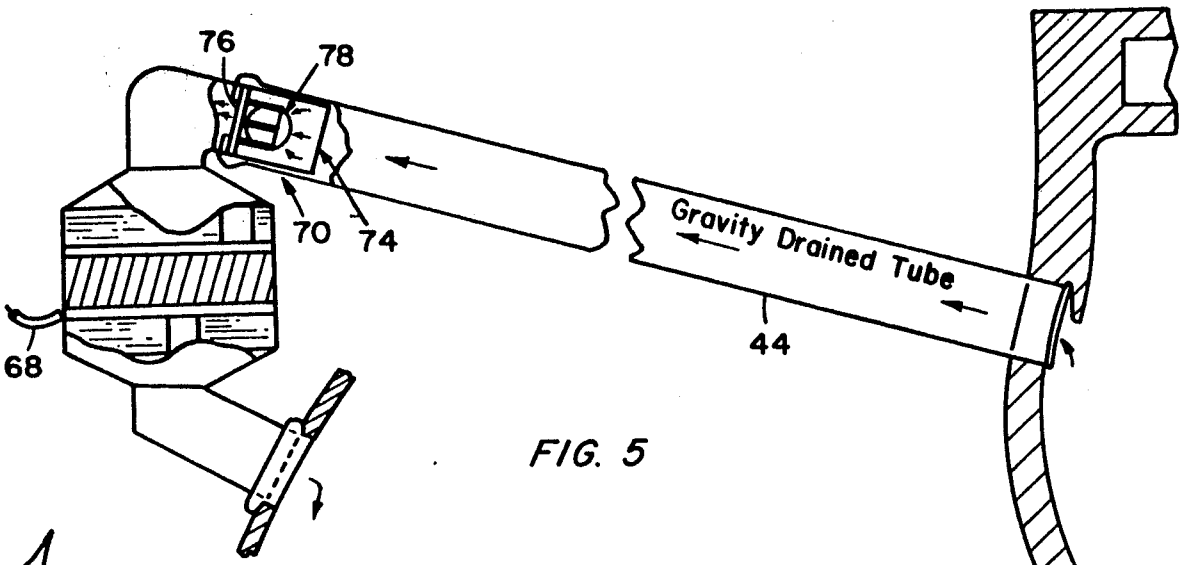
FIG. 5 is a cutaway side elevational view of a ventilation system having a flow control means therein located upstream of the fan and downstream of the toilet bowl for preventing water from the toilet bowl from entering the fan.
Figure 15:
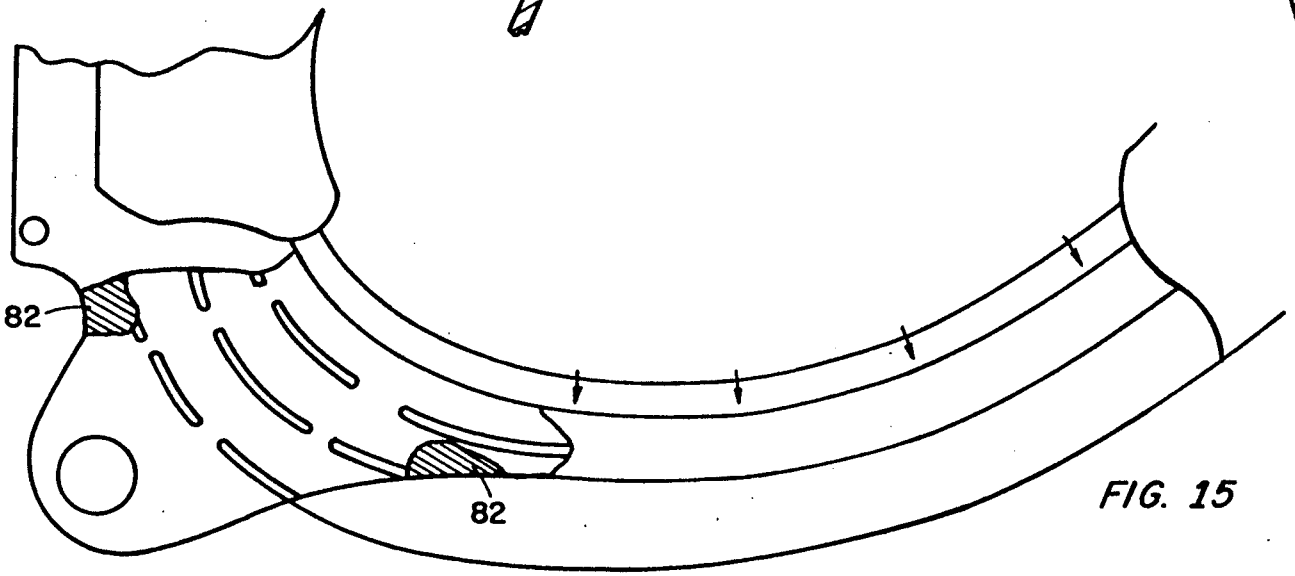
FIG. 15 is a partially cutaway top view of the air pick-up manifold shown in FIG. 14.
Figure 6:
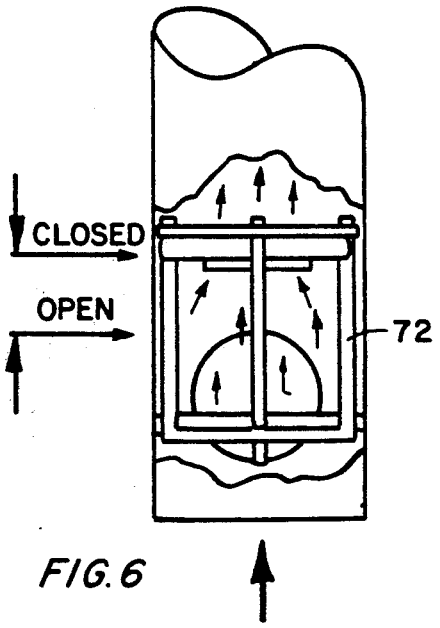
FIG. 6 is a cutaway side elevational view of the flow control means also shown in FIG. 5.

Since the air pick-up conduit is in direct communication with the interior of the toilet bowl, the system of the present invention includes a flow control valve 70, best shown in FIGS. 5 and 6, to ensure that any water that does move into the air pick-up conduit will not reach the fan. The valve 70 includes a cage 72 that is mounted in the air pick-up conduit. The cage includes an inlet end 74 and an outlet end 76, with the outlet end being located adjacent to the air pick-up conduit outlet end 50 and the inlet end 74 being located upstream of the outlet end 76. The valve 70 includes a ball 78 that is sized to cover the inlet of the fan inlet section 56 to occlude that inlet section. The ball moves between a flow-permitting position adjacent to the cage inlet end as shown in FIG. 6 and a flow-blocking position covering the inlet to the section 56.

The ball 78 has a specific gravity that is less than the specific gravity of water whereby the ball will float in water, but that is greater than the specific gravity of air whereby the ball will permit air to flow therearound as indicated in FIG. 6. Since the cage is oriented in the angled pick-up conduit, the ball is biased by gravity into the open, or flow-permitting position shown in FIG. 6. The preferred material for ball 78 is a plastics-type material that will not degrade under the influence of the fluids to which it will be exposed.

Yet another form of the ventilating system of the present invention is shown in FIGS. 9-16. This form includes an air pick-up manifold 80 that is mounted on the bowl near the water storage tank and rests on the upper rim of that bowl. The manifold will remove air from the total circumference of the toilet so it is quite effective, and can be hingeably connected to the bowl so the upper rim can be cleaned, or can be fixed to that upper rim as by adhesive 82 (see FIG. 15) or the like. The manifold has an air discharge port 84 which is fluidically connected to an inlet end of a vertically oriented discharge conduit 86. The conduit 86 extends through the floor 24 to be connected to the remainder of the discharge system as will be discussed below.

Figure 11:
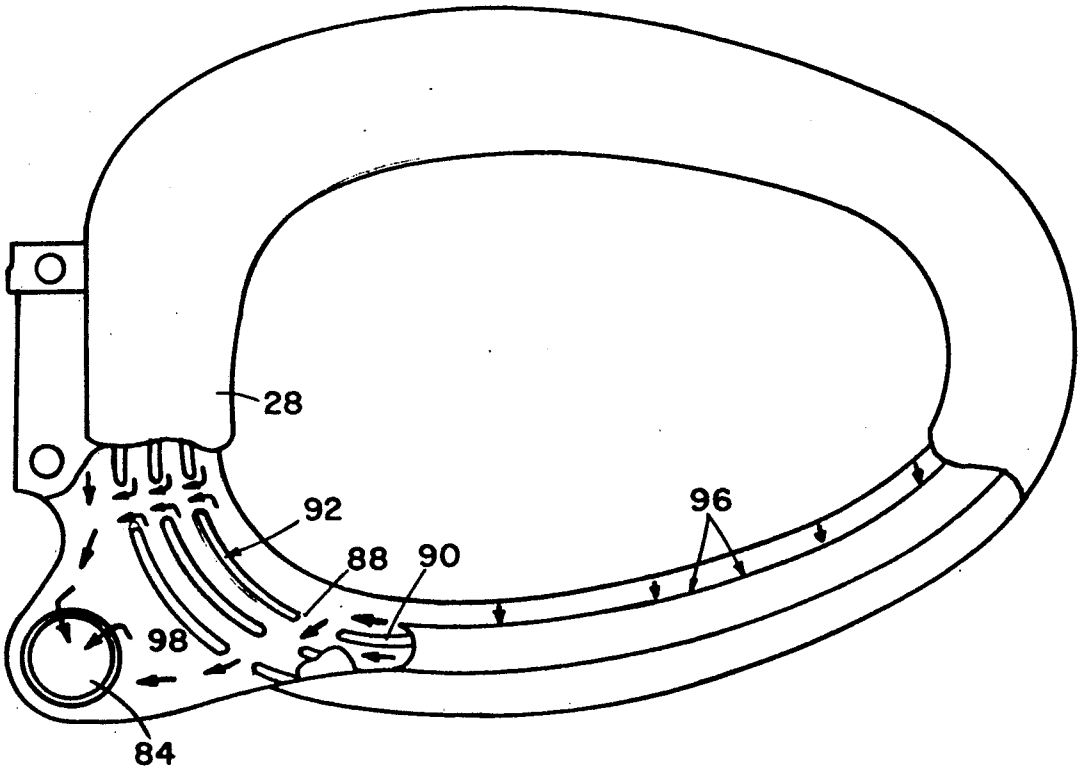
FIG. 11 is a partially cutaway top view of an air pick-up manifold that is used in one form of the ventilating system of the present invention.
Figure 12:
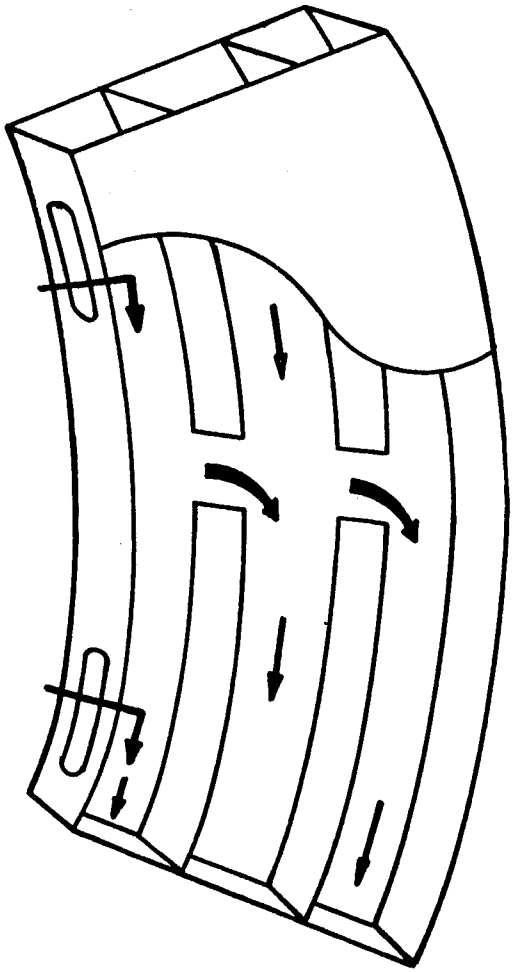
FIG. 12 is an enlarged cutaway view of the air pick-up manifold showing part of the baffle system therein.

The manifold is best shown in FIGS. 11 and 12 and includes a baffle system 88 located inside of an outer skin 90. The baffle system includes a plurality of support ribs 92 separated from each other by a plurality of air circulation gaps, such as gap 94. Air enters the manifold system via a plurality of air collection ports, such as ports 96. The air circulates through the baffle system and enters the discharge port as indicated by arrows 98.

Figure 13:
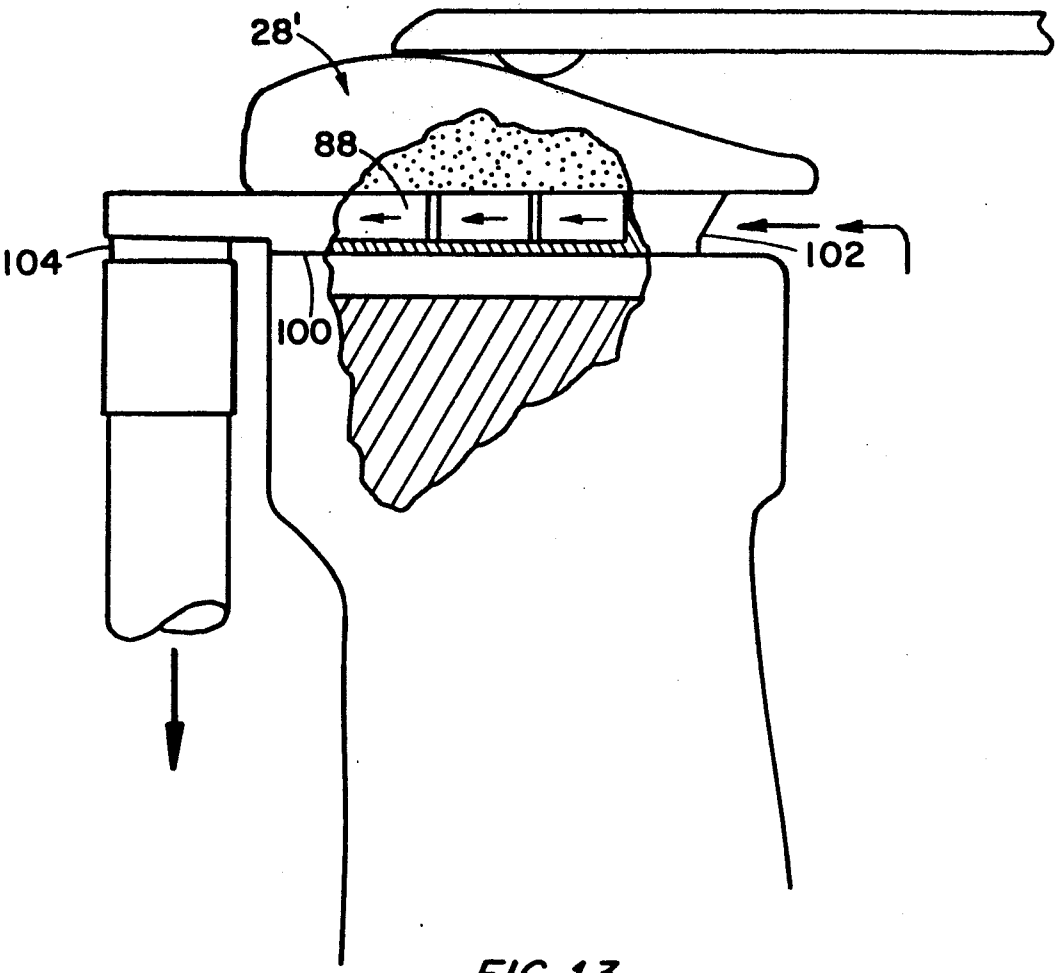
FIG. 13 illustrates the form of the invention which includes a vertically oriented air pick-up discharge conduit and an air pick-up manifold connected to the toilet bowl and resting on the rim of the bowl between the toilet seat and the rim.
Figure 25:
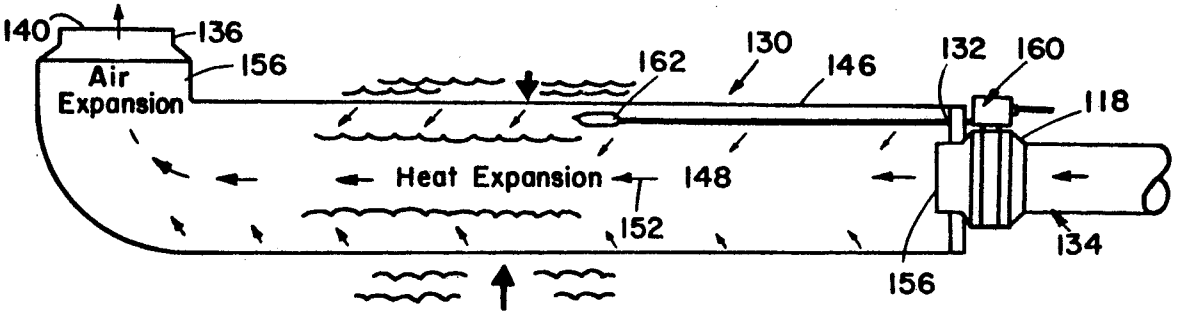
FIG. 25 is a cutaway side elevational view of a solar energy driven expansion chamber in a first condition prior to the movement of air out of that chamber, a temperature sensor controlled fan system is also shown in FIG. 25.
Figure 26:
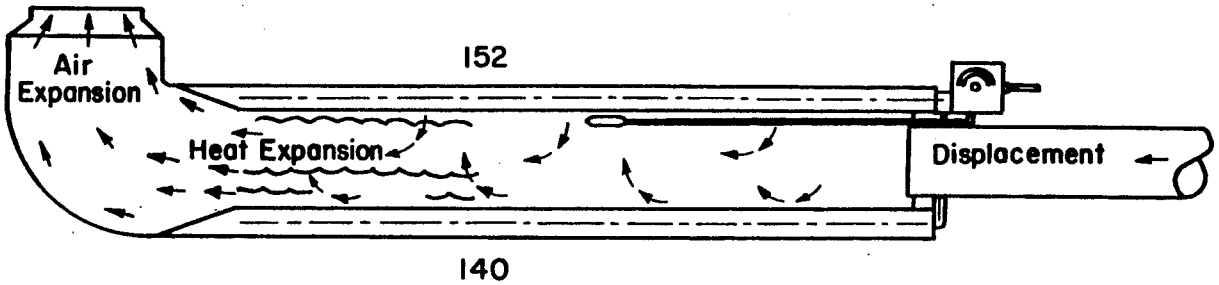
FIG. 26 shows the FIG. 25 expansion chamber in condition to force air out of the chamber and to thereby place a flow producing pressure gradient on the air discharge system of the present invention.
Figure 14:
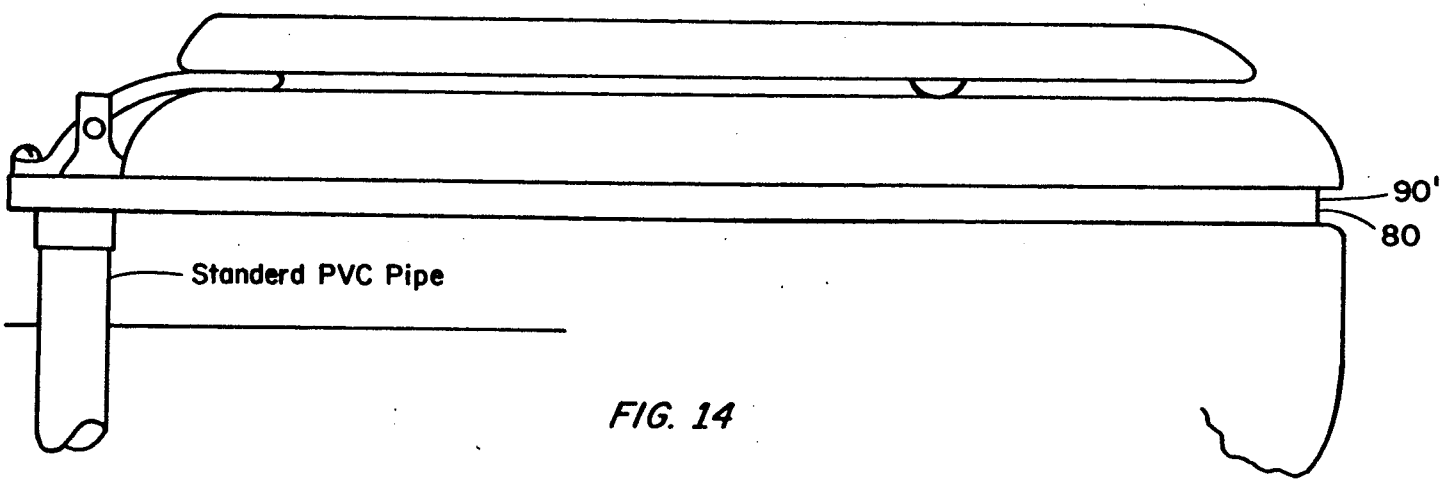
FIG. 14 is a side elevational view of the form of the invention having an air pick-up manifold located between a conventional toilet seat and the upper rim of the toilet bowl.
Figure 16:
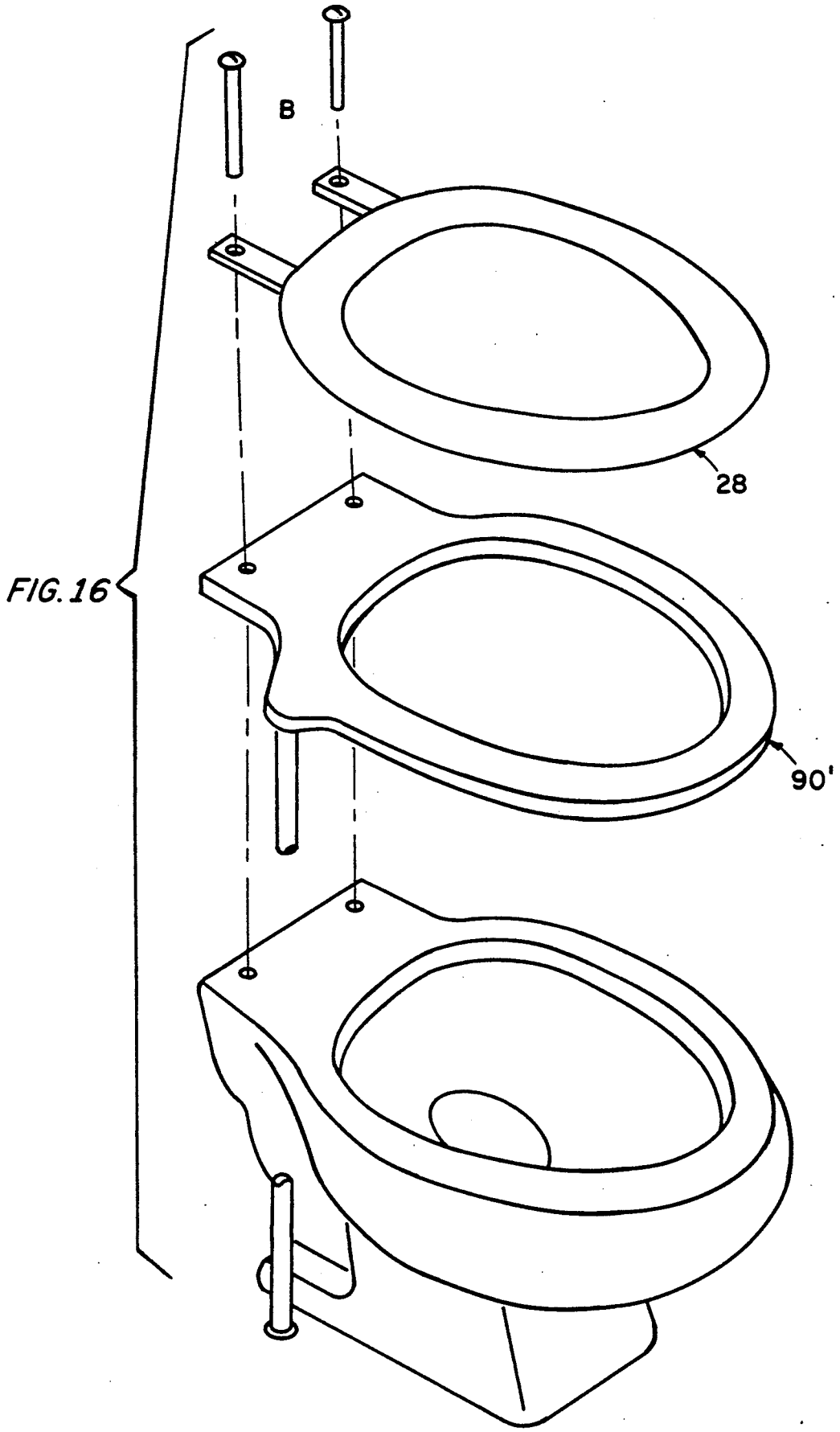
FIG. 16 is an exploded perspective view of a water closet having an air pick-up manifold associated therewith.

As shown in FIG. 13, the manifold is located between a toilet seat and the upper rim of the toilet bowl. The seat can be specially modified to rest on top of the manifold as indicated for seat 28' in FIG. 13, and air can be drawn into the bowl due to the pressure gradient established by the ventilating system as indicated in FIG. 13. The manifold can also have a planar base 100 and an angled front wall 102 whereby secure and stable contact is established between the manifold and the seat and between the manifold and the bowl. A special nipple connection 104 fluidically connects the discharge conduit 86 to the manifold. The manifold can also be tubular or cylindrical as shown in FIG. 14 for manifold 90' with the toilet seat 28 being shaped as usual. The assembly of the manifold to the toilet bowl is indicated in FIG. 16. The system can be sold as a retro-fit kit, in which bolts, such as bolts B, are used to ensure proper alignment and proper placement of the manifold on the toilet bowl. It is also noted that since toilet bowls are generally one of two shapes, oval or circular, the retro-fit kit can be provided in these two shapes as well. A moisture trap can also be included in the piping system and sold with the kit. The preferred form of materials include plastic and P.V.C. pipe that are not subject to corrosion, stress cracks or physical breakdown.

Figure 17:
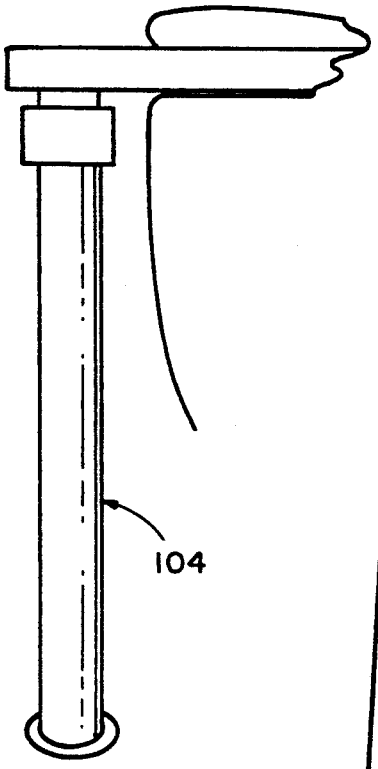
FIG. 17 is a side elevational view of a vertically oriented air pick-up discharge conduit.
Figure 18:
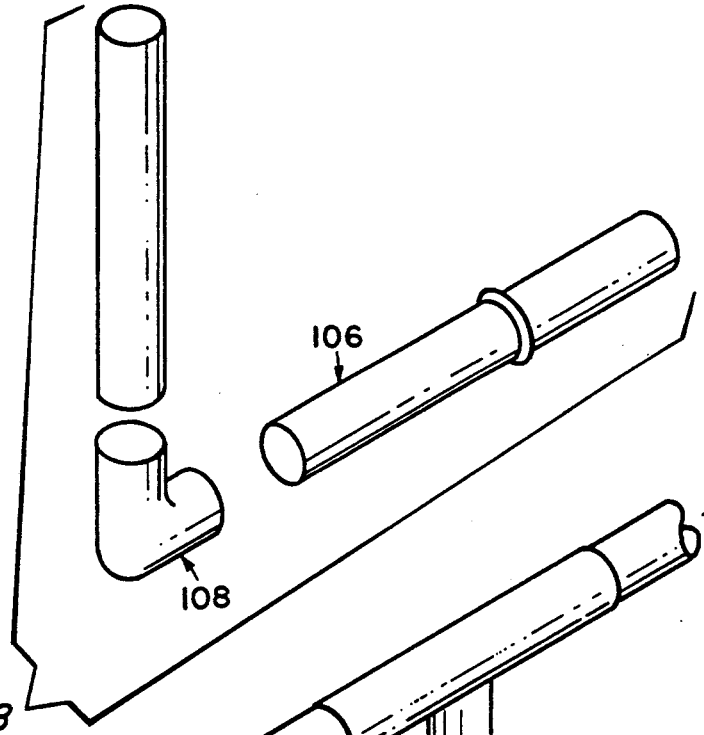
FIG. 18 illustrates an exploded perspective view of an air pick-up discharge system that can be used to connect a plurality of water closets to a single ventilating system.
Figure 19:
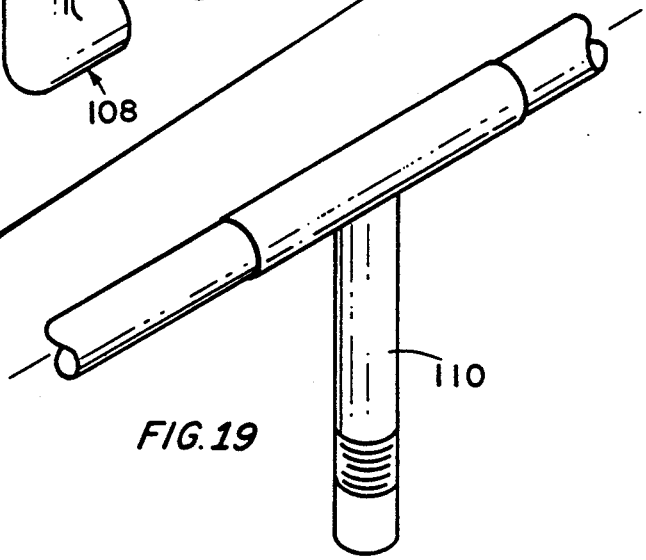
FIG. 19 illustrates an assembled view of a portion of the air discharge system also shown in FIG. 18.
Figure 20:
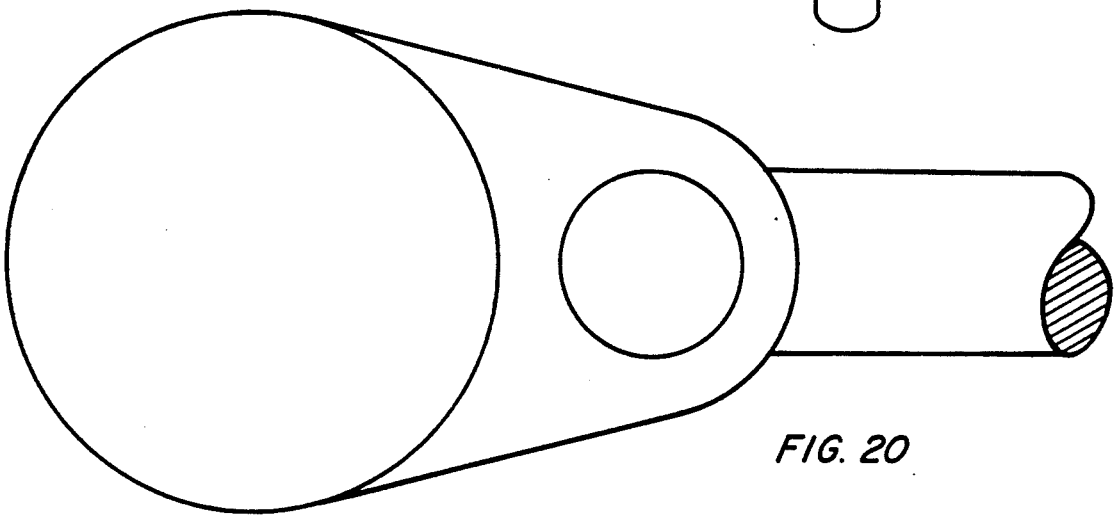
FIG. 20 is a top view of a fluid flow control valve/fan combination.

If a plurality of toilets are to be connected to a single ventilating system, a system of conduits, such as indicated in FIGS. 17-19 can be used. The conduits include the vertically oriented discharge conduit adjacent to each toilet, such as conduit 104 shown in FIG. 17, connected to a cross conduit, such as conduit 106 via an elbow connection 108, a moisture trap 110, or the like. The cross conduits are all connected to a fan or other fluid moving means and air from each toilet is drawn into the overall system. Appropriate moisture traps can also be included in the piping system as necessary.

Figure 21:
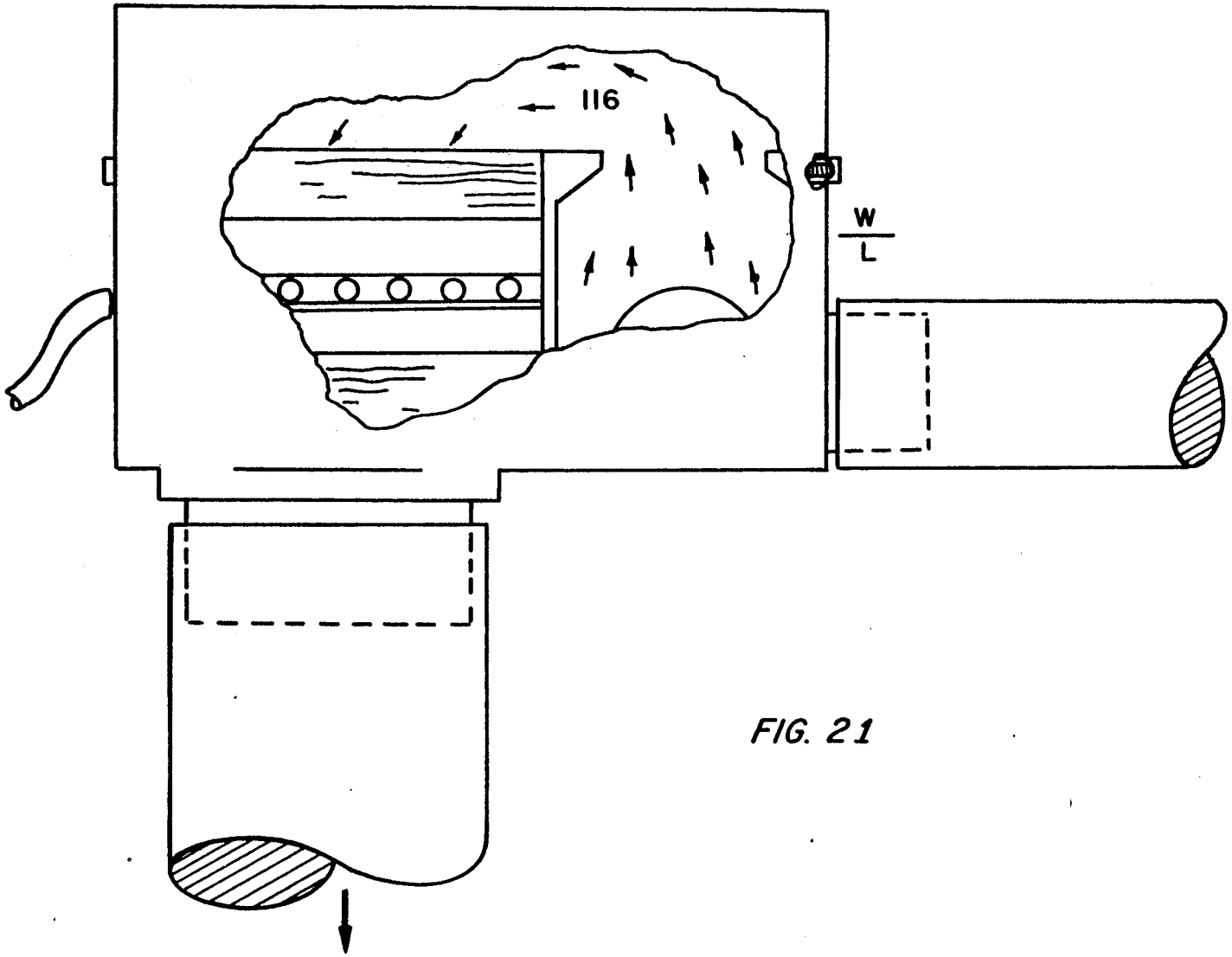
FIG. 21 is a cutaway side elevational view of the fluid flow control valve/fan combination shown in FIG. 20 with the fluid flow control valve in the open, flow permitting, condition.
Figure 22:
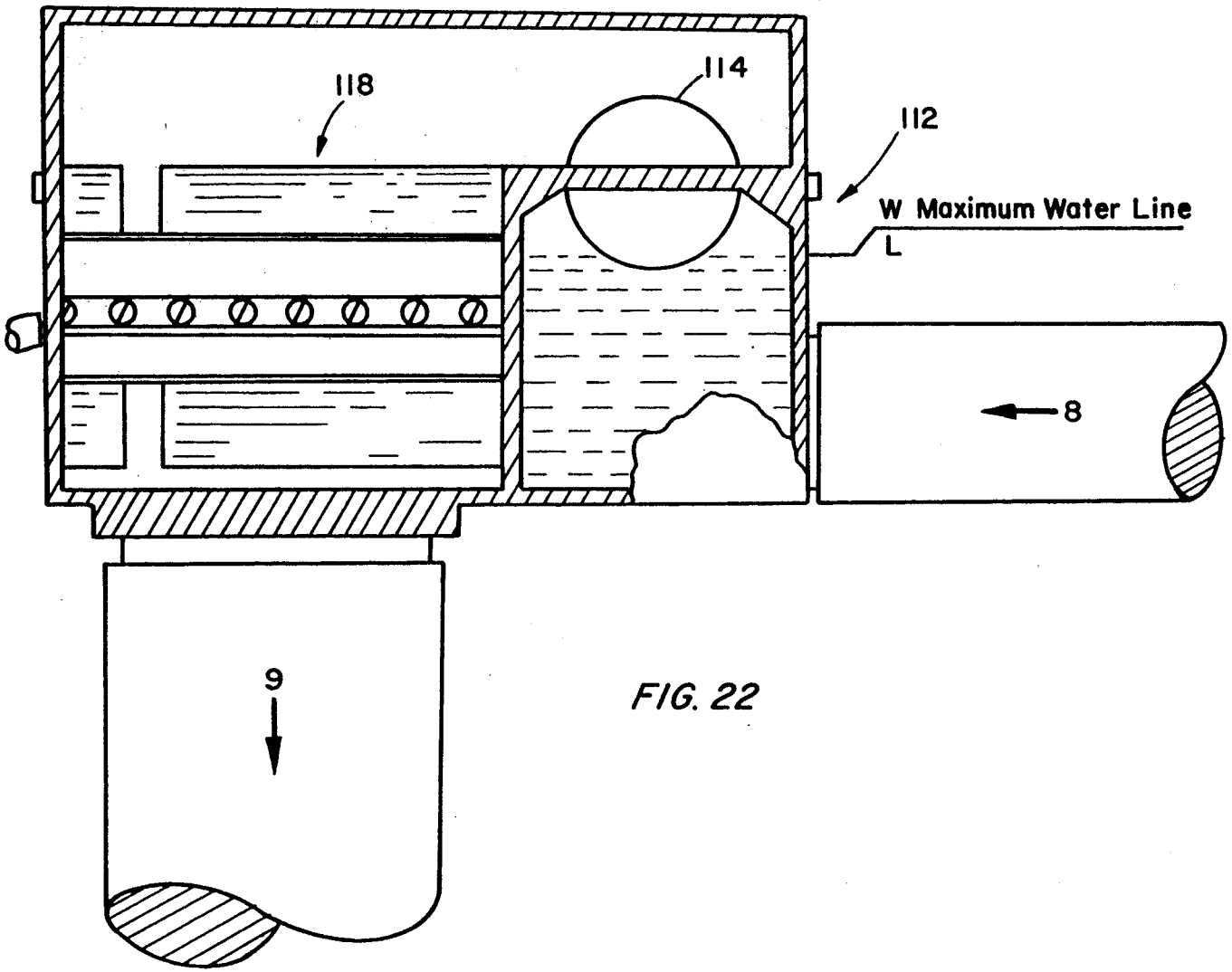
FIG. 22 is a cutaway side elevational view of the fluid flow control valve/fan combination shown in FIG. 20 with the fluid flow control valve in the closed, flow blocking, condition.

Fluid flow control valves similar to the valve discussed above can also be incorporated in the overall system as necessary. A fluid flow control valve suitable for use in conjunction with the vertically oriented discharge conduits is shown in FIGS. 21 and 22 as valve 112. The valve 112 functions in a manner that is similar to the above-discussed valve in that a ball 114 is trapped in an upright cage 116 and moves between a flow-permitting, open, position shown in FIG. 21, and a flow-preventing, closed, position shown in FIG. 22. The ball containing cage is located upstream of a fan 118 and downstream of the air pick-up discharge conduit. The air discharge conduit is shown in FIGS. 21 and 22 as being horizontally oriented for the sake of a complete disclosure. However, the discharge conduit can be oriented in other manners as well. The ball 114 is similar to the ball 78 in that it floats in water but not in air, even if that air is flowing past the ball as indicated in FIG. 21.

Figure 24:
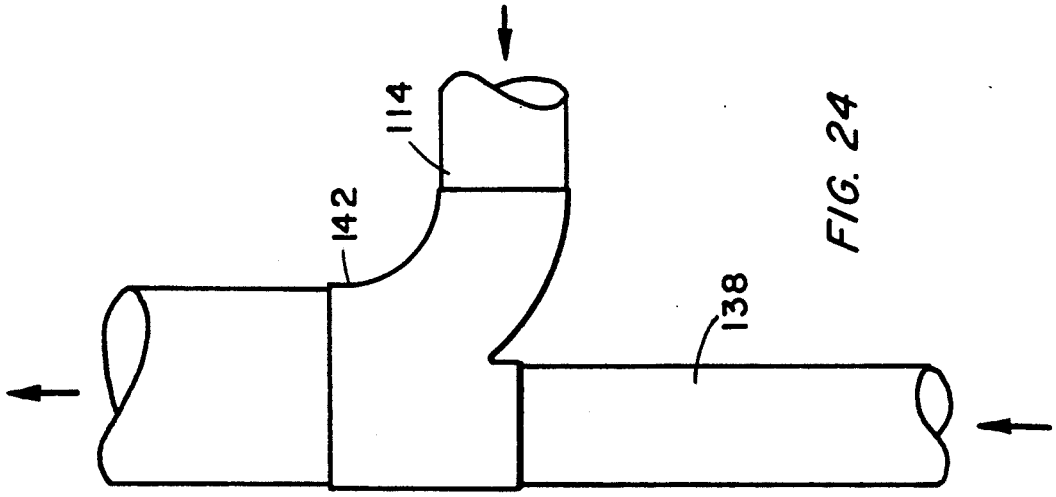
FIG. 24 is a side elevational view of a connection between the solar energy driven power source and an air pick-up discharge conduit.
Figure 23:
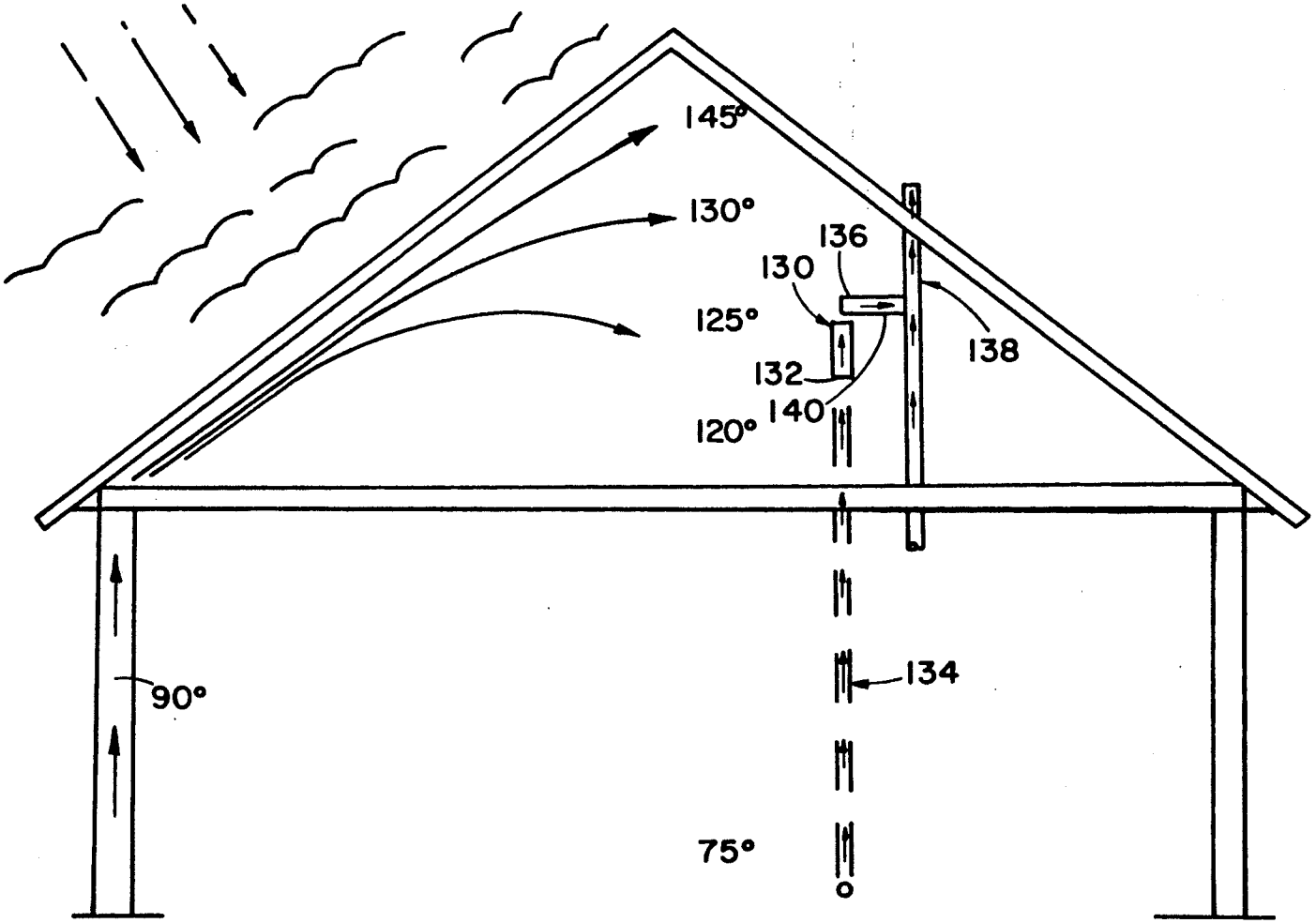
FIG. 23 is an elevational view of a solar energy driven power source for the ventilating system of the present invention.

A solar energy-driven embodiment of the ventilating system is shown in FIGS. 23–26. This form of the system includes an expansion chamber 130 positioned in a location that generally has higher temperatures than the rest of the system. For example, the expansion chamber can be located in an attic that is subject to direct sunshine as indicated in FIG. 23, with temperatures as are also indicated in FIG. 23. The expansion chamber has an inlet end 132 thereof fluidically connected to one end of the discharge conduit 134, and an outlet end 136 thereof fluidically connected to a further exhaust pipe 138 by a coupling pipe 140. The coupling pipe is connected to the exhaust pipe 138 by a y-connection 142 as shown in FIG. 24.

The expansion chamber is larger in cross sectional area than the discharge pipe, and has a heat conducting wall 146 whereby the interior 148 thereof is heated. The chamber is shaped to retain the heat, and can include a lining that contributes to this heat retention feature. The hot interior of the chamber causes air in the chamber to expand, and the shape of the chamber along with the relative sizes of the inlet and outlet openings of the chamber, 156 and 158 respectively, causes the heated air to move in the direction indicated in FIGS. 25 and 26 by arrows 152. This air flow creates a pressure gradient on the air in the remainder of the ventilating system whereby a draft is created on the toilet bowls. This draft tends to pull air out of the toilet bowls in the manner of a fan whereby a constant movement of air is created. However, due to the thermally-induced nature of the gradient, no moving parts are required for such a system.

If the thermally-induced gradient is to be enhanced, a temperature controlled fan can be included. Such a fan can be similar to or identical to the fan 118. The fan 118 is thus connected to a temperature controlled network 160 that includes a temperature probe 162 located inside the expansion chamber and connected to a control circuit. The control circuit can be similar to the thermostat found in home heating systems and operates to close an on/off switch connecting the fan to a power source when temperature in the expansion chamber drops below a preset level. The temperature controlled circuit will shut the fan off when temperature in the expansion chamber rises above a preset level. The preset level is selected to correspond to the level at which the pressure gradient associated with the pressure in the expansion chamber is sufficient to operate the ventilating system as above described.

Another way to enhance the temperature gradient is to include heaters in the expansion chamber, such as heater 170 located on the inner surface of the chamber. The heaters are connected to the above-discussed temperature controlled circuit to be turned on whenever the temperature in the chamber drops below a preset level. The preferred form of heater is electric.

It is understood that while certain forms of the present invention have been illustrated and described herein, it is not to be limited to the specific forms or arrangements of parts described and shown.

I claim:

1. A ventilating system for continuously removing air from a toilet bowl comprising:

A) a toilet bowl having a front end, a rear end, a wall, a top rim on said wall, a sewage discharge pipe, and a sewer trap on said discharge pipe, water moving from said bowl to said discharge pipe in a downstream direction during a flush cycle whereby said trap is downstream of said bowl;

B) means for continuously removing air from said toilet bowl including (1) an air pick-up conduit mounted in said toilet bowl and having an inlet fluidically connected with the interior of said toilet bowl and an outlet positioned vertically above said inlet and located outside of said toilet bowl, said pick-up conduit being oriented nearly horizontally and at an angle with respect to vertical, (2) a fan fluidically connected to said air pick-up conduit outlet to receive air therefrom, (3) said fan having an inlet fluidically connected to said air pick up conduit to receive air therefrom and an outlet fluidically connected to said toilet drainage system downstream of said trap, (4) a fluid flow control valve in said air pick-up conduit upstream of said fan, said valve including (a) a cage having an inlet end and an outlet end, said outlet end being located adjacent to said air pick-up conduit outlet and being located downstream of said inlet end, said cage being oriented nearly horizontally and including a plurality of spaced apart side struts extending along said air pick-up conduit, a first strut located adjacent to said cage outlet end and a second strut located adjacent to said cage inlet end, said side strut connecting said first and second struts together, said cage including an outlet in said outlet end, with said outlet being spaced apart from said side struts, and (b) a ball located in said cage and movable between a flow-permitting position adjacent to said cage inlet end and a flow-blocking position covering said outlet, said cage being located in said pick-up conduit and being angled with respect to vertical to have said cage inlet located below said cage outlet, said ball having a specific gravity greater than the specific gravity of air and less than the specific gravity of water whereby gravity biases said ball into said flow-permitting position and air flowing through said pick-up conduit will flow past said ball and water flowing past said ball moves said ball toward said flow-blocking position; and C) a power source connected to said fan.

2. The ventilating system defined in claim 1 wherein said fan is and axial flow fan.

3. The ventilating system defined in claim 1 wherein said toilet bowl includes a lip overhanging said air pick-up conduit inlet.

* * * * *